US006955208B2

(12) United States Patent
Kim

(10) Patent No.: US 6,955,208 B2
(45) Date of Patent: Oct. 18, 2005

(54) SUNSHADE OPERATING ROPE WITH AN OPERATING DIRECTIONAL INDICATOR

(76) Inventor: Hwa-Soon Kim, 386, Siksa-dong, Ilsan-gu, 411-820 Goyang-si, Gyeonggi-do (KR)

( * ) Notice: Subject to any disclaimer, the term of this patent is extended or adjusted under 35 U.S.C. 154(b) by 0 days.

(21) Appl. No.: 10/492,658

(22) PCT Filed: Oct. 11, 2002

(86) PCT No.: PCT/KR02/01908

§ 371 (c)(1),
(2), (4) Date: Apr. 13, 2004

(87) PCT Pub. No.: WO03/033853

PCT Pub. Date: Apr. 24, 2003

(65) Prior Publication Data

US 2004/0244921 A1 Dec. 9, 2004

(30) Foreign Application Priority Data

Oct. 16, 2001 (KR) ..... 20-2001-0031612
Aug. 20, 2002 (KR) ..... 20-2002-0024738

(51) Int. Cl.[7] ..... E06B 9/38
(52) U.S. Cl. ..... 160/321; 160/178.1 V
(58) Field of Search ..... 160/321, 178.1 V, 160/178.1 R, 319, 320, 331, 173 V, 332; 474/203, 154; 59/78, 80, 81, 2

(56) References Cited

U.S. PATENT DOCUMENTS

| | | | | |
|---|---|---|---|---|
| 4,424,852 A | | 1/1984 | Hopper | |
| 4,552,195 A | | 11/1985 | Dürig et al. | |
| 4,884,618 A | * | 12/1989 | Steeves | 160/321 |
| 4,919,186 A | | 4/1990 | Uecker et al. | |
| 4,932,456 A | | 6/1990 | Buxbaum | |
| 5,137,073 A | * | 8/1992 | Huang | 160/321 |
| 5,718,277 A | | 2/1998 | Prosch | |
| 5,845,696 A | | 12/1998 | Chou | |
| 6,250,359 B1 | * | 6/2001 | Lorio et al. | 160/178.1 V |

* cited by examiner

*Primary Examiner*—David Purol
(74) *Attorney, Agent, or Firm*—Thorpe North & Western

(57) ABSTRACT

This device is related to an operating rope wound on a sprocket of clutch for operating a sunshade. When a user pulls the operating rope to either opening or closing direction, a shaft being attached to the sprocket and clutch is rotated to open or close the sunshade. The operating rope comprises a primary rope (4) and a plurality of beads (5) being integrally fixed on the primary rope (4) with equidistant intervals. The primary rope (4) passes through the center of the beads (5) being made of plastic. The beads (5) are also formed with the directional indicators to avoid the wrong operation of the sunshade. The plurality of beads having a different cross section at the top and bottom with respect to the center is aligned in series to indicate an operating direction.

4 Claims, 7 Drawing Sheets

SUNSHADE OPERATING ROPE WITH AN OPERATING DIRECTIONAL INDICATOR

This application is a national stage of International Application No. PCT/KR02/01908, filed Oct. 11, 2002.

TECHNICAL FIELD

The present invention is related to a sunshade operating rope, more particularly, the operating rope formed with a directional indicator to avoid a wrong operation of the sunshade.

BACKGROUND ART

Generally, a purpose of the operating rope is for operating the sunshade. As shown in FIGS. 3a and 3b, when a user pulls the operating rope wound on a sprocket of clutch to either opening or closing direction, a shaft attached to the sprocket and clutch is rotated to open or close the sunshade.

On the other hand, the operating ropes are mainly divided into two sorts, a simple operating rope and the operating rope with beads. The simple operating rope has only primary rope stranded the several yarns. The other operating rope has a plurality of plastic beads attached on the primary rope with equidistant intervals.

FIGS. 7*a*, 7*b*, 8*a* and 8*b* show the conventional sunshade operating rope (13) having a plurality of beads attached on the primary rope and arranged with equidistant intervals. The bead has desirably formed a spherical or cylindrical shape, or other suitable shapes. FIGS. 7(*a*) and 8(*a*) show the sunshade operating rope (13) with a plurality of spherically shaped beads being attached on the primary rope. FIGS. 7*b* and 8*b* show the sunshade operating rope (13) with a plurality of cylindrically shaped beads being attached on the primary rope.

However, the sunshade operating rope is wound on a sprocket of clutch to hang on both opening and closing sides. When a user wants to pull the sunshade operating rope either opening or closing direction, the user often cannot distinguish which is the correct one to operate his intended direction. Due to the confusion, many users are experienced to pull initially the wrong direction of the sunshade operating rope.

DISCLOSURE OF INVENTION

In order to solve the above-mentioned problems, the present invention is provided an operating rope having a directional indicator (5*a*).

A sunshade operating rope (3) of the present invention comprises a primary rope (4) and a plurality of beads (5) being integrally fixed on the primary rope (4) with equidistant intervals. The primary rope (4) passes through a center of the beads (5) being made of plastic materials. The beads (5) are also formed with the directional indicators to avoid the wrong operation of the sunshade. The bead (5) has a different cross section of top and bottom with respect to the center and aligns in series to indicate an operating direction. The operating rope is wound on a sprocket of clutch for operating a sunshade. When a user pulls the operating rope to either opening or closing direction, a shaft attached to the sprocket and clutch is rotated to open or close the sunshade.

BRIEF DESCRIPTION OF DRAWINGS

FIG. 3*a* is a schematic drawing of an operating rope wound on a sprocket of clutch according to the first embodiment of the present invention, while

DETAILED DESCRIPTION OF THE PREFERRED EMBODIMENTS

Hereinafter, the detailed description is presented accompanying with the drawings.

The sunshade operating rope (3) of the present invention is designed to have a function of indicating the operational direction on the plurality of beads (5). The primary rope (4) is pierced through the center of the beads (5). The cross section of the bead (5) has different width at top and bottom with respect to the center. A plurality of beads (5) attached on the operating rope is aligned in series for indicating an operating direction.

Figure 1A:
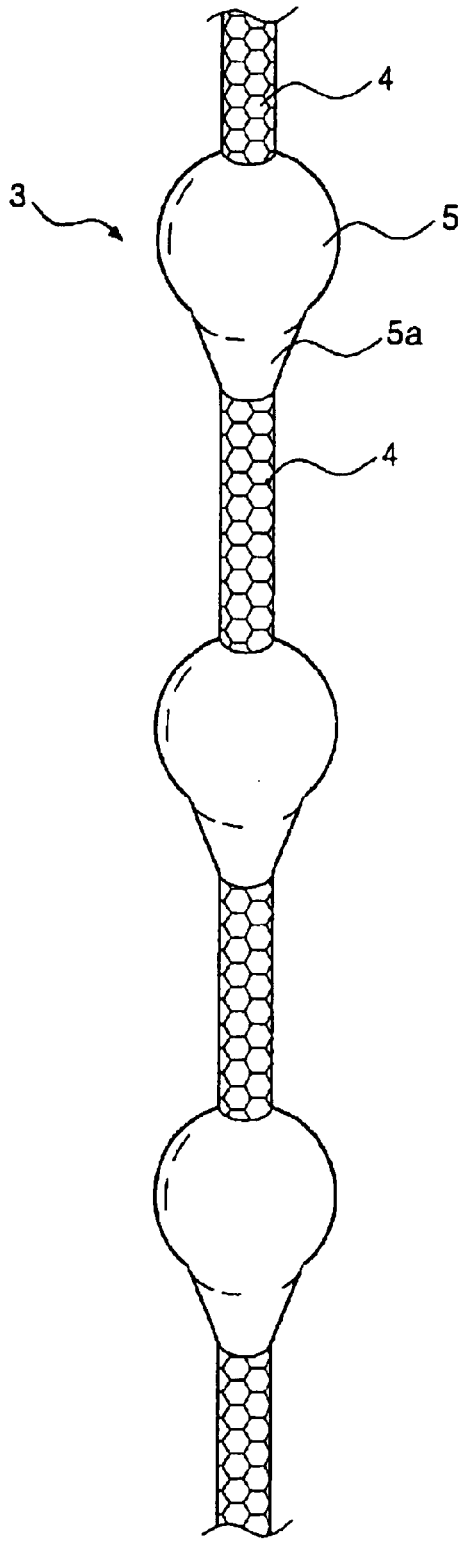
FIG. 1*a* and FIG. 1*b* are a schematic drawing of a sunshade operating rope according to the first embodiment of the present invention.
Figure 1B:
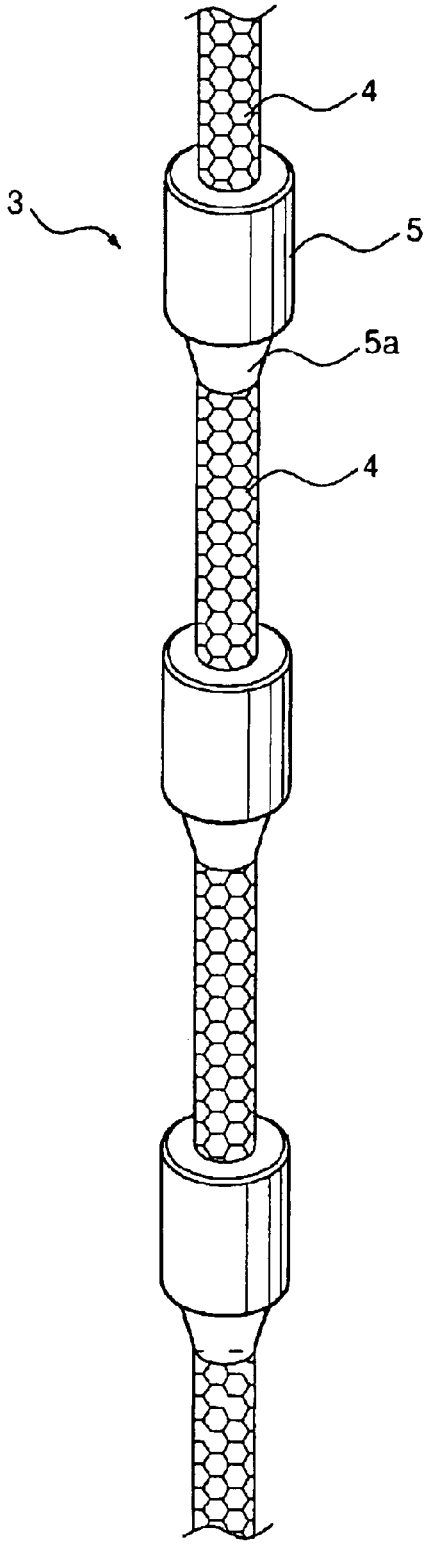
Figure 2A:
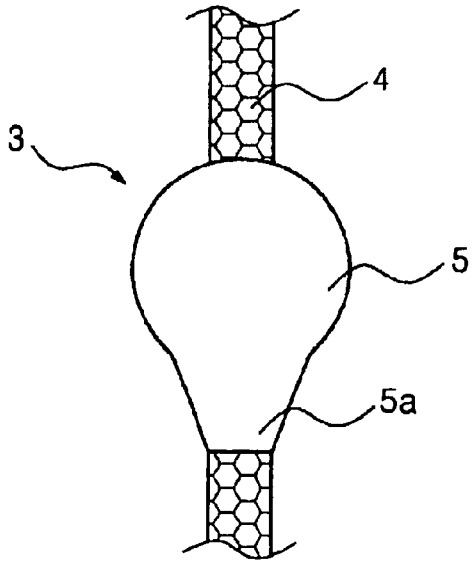
FIG. 2*a* and FIG. 2*b* are front view of a typical bead with a directional indicator attached on an operating rope according to the first embodiment of the present invention.
Figure 2B:
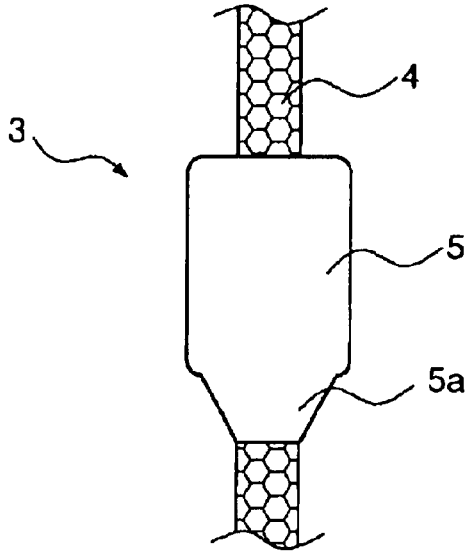

FIG. 1*a* and FIG. 1*b* illustrate a sunshade operating rope according to the first embodiment of the present invention. FIG. 2*a* and FIG. 2*b* also illustrates a front views of a detailed bead integrally formed with a directional indicator and attached on an operating rope.

A sunshade operating rope (3) of the present invention comprises a primary rope (4) and a plurality of beads (5). The plurality of beads (5) is arranged with equidistant interval and fixed on the primary rope (4). A directional indicator is disposed either top or bottom of the bead (5) and aligned in series with equidistant intervals to point an operating direction. The size of directional indicator (5*a*) is relatively smaller than that of beads (5) with respect to the cross sectional area.

In order to easily grasp the bead with soft touching, the bead is desirably formed a spherical or cylindrical shape, or possibly formed other suitable shapes. FIGS. 1*a* and 2*a* illustrate the sunshade operating rope (3) with a plurality of spherically shaped beads being attached on the primary rope. FIGS. 1*b* and 2*b* illustrate the sunshade operating rope (3) with a plurality of cylindrically shaped beads being attached on the primary rope.

In the first embodiment, the plurality of beads (5) is integrally formed with the directional indicators (5*a*) as a solid piece. The directional indicator (5*a*) disposed either top end or bottom end of the beads (5) has a conical shape for pointing an operating direction.

Figure 3A:
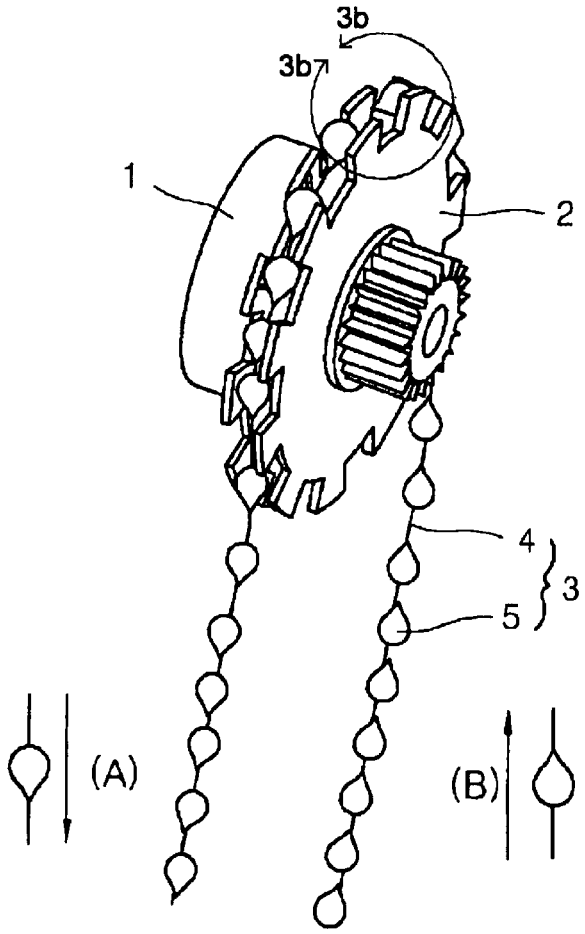
Figure 3B:
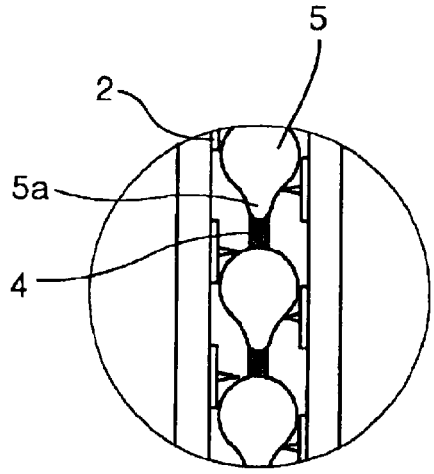
FIG. 3*b* is a detailed view thereof.

As shown in FIGS. 3*a* and 3*b*, the sunshade operating rope (3) of the present invention is wound on a sprocket (2) of clutch. Herein, the directional indicators (5*a*) being integrally formed with the beads (5) are aligned on the sunshade operating rope (3) to indicate an operating direction in a manner of pointing downward for opening direction or pointing upward for closing direction.

Therefore, the pointing of the directional indicator (5*a*) indicates a specific operating direction. When a user wants to open the sunshade, the user is able to easily and correctly distinguish the opening direction of the operating rope (3) with pointing downward (A) of the directional indicator (5*a*). When a user wants to close the sunshade, the user is able to easily and correctly distinguish the closing direction of the operating rope (3) with pointing upward (B) of the directional indicator (5*a*).

Figure 4A:
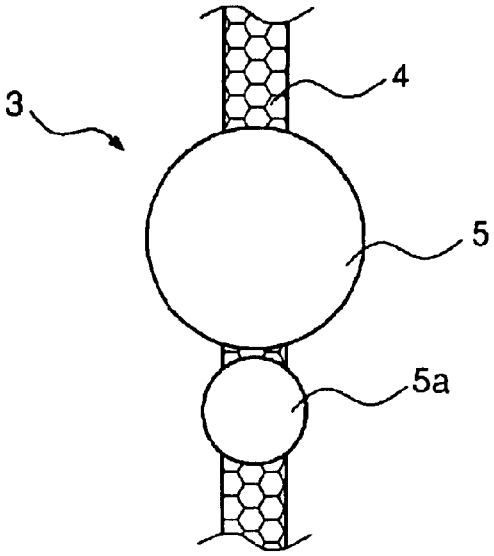
FIG. 4*a* and FIG. 4*b* are front views of a typical bead and a directional indicator disposed on an operating rope according to the second embodiment of the present invention.
Figure 4B:
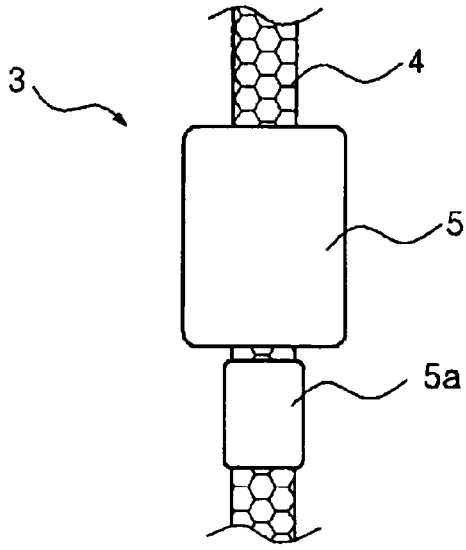

FIG. 4*a* and FIG. 4*b* illustrates a bead and directional indicator being attached on an operating rope of the second embodiment of the present invention. In the second embodiment, a bead (5) and directional indicator (5*a*) are separately and closely disposed on the operating rope (3). FIG. 4(*a*) illustrates the sunshade operating rope (3) with a plurality of spherically shaped beads (5) and directional indicators (5*a*) being separately attached on the primary rope. FIG. 4(*b*) illustrates the sunshade operating rope (3) with a plurality of cylindrically shaped beads (5) and directional indicators (5*a*) being separately attached on the primary rope (3).

As shown in the first embodiment, the directional indicator (5*a*) integrally disposed either top or bottom of the bead (5) has a conical shape for pointing a specific operating direction. However, in the second embodiment, the directional indicator (5*a*) and bead (5) are separately and closely disposed each other on the operating rope (3). The directional indicator (5*a*) has identical shape with the bead (5). But, the size of the directional indicator (5*a*) is much smaller than that of the bead (5). As shown in FIG. 4*a*, the bead (5) and directional indicator (5*a*) having spherical shape with different size are disposing separately and closely each other on the operating rope (3) for indicating a specific operating direction. FIG. 4*b* illustrates the bead (5) and directional indicator (5*a*) having cylindrical shape with different size are disposing separately and closely on the operating rope (3) for indicating a specific operating direction.

As mentioned before, it is possible to use any shape of directional indicator (5*a*) for indicating a specific operating direction. For example, the directional indicator (5*a*) could be formed with a conical, spherical, cylindrical, semi-spherical or oval shape for indicating a specific operating direction.

Figure 5:
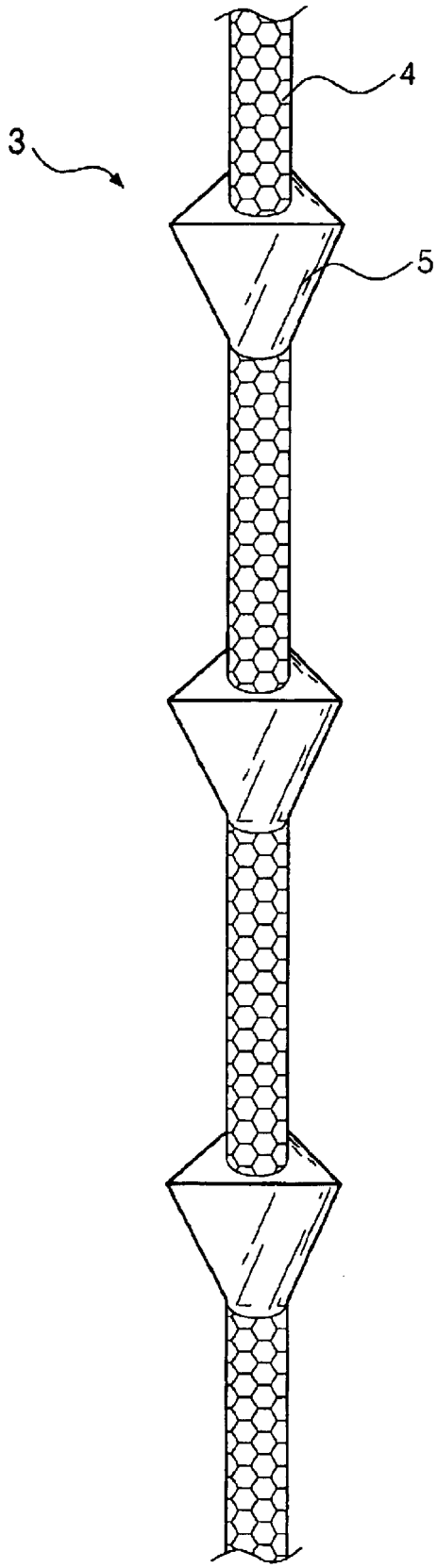
FIG. 5 is a schematic drawing of a sunshade operating rope according to the third embodiment of the present invention.
Figure 6:
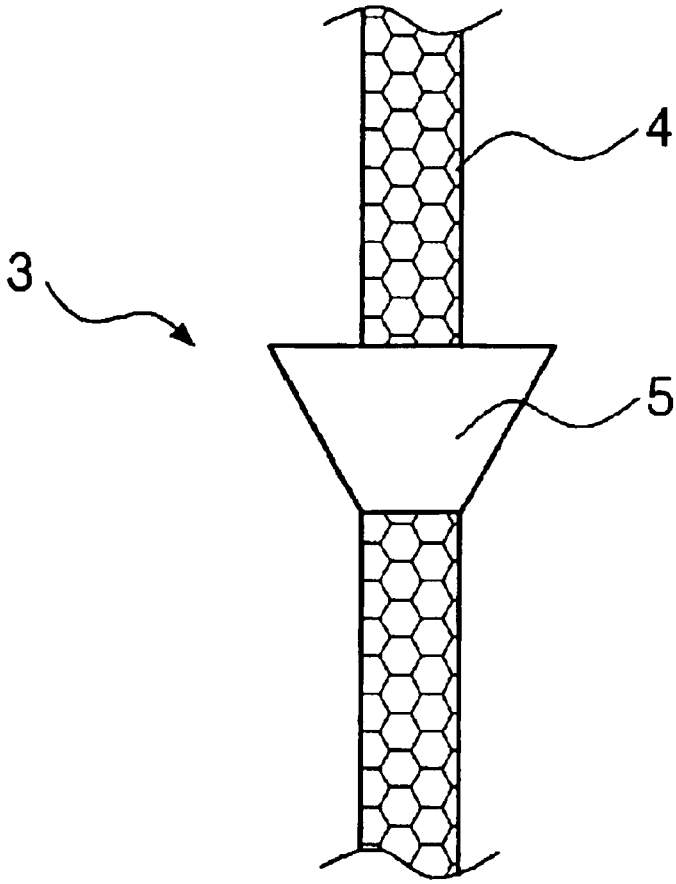
FIG. 6 is a front view of a trapezoidal shaped bead with a directional indicator attached on an operating rope according to the third embodiment of the present invention.
Figure 7A:
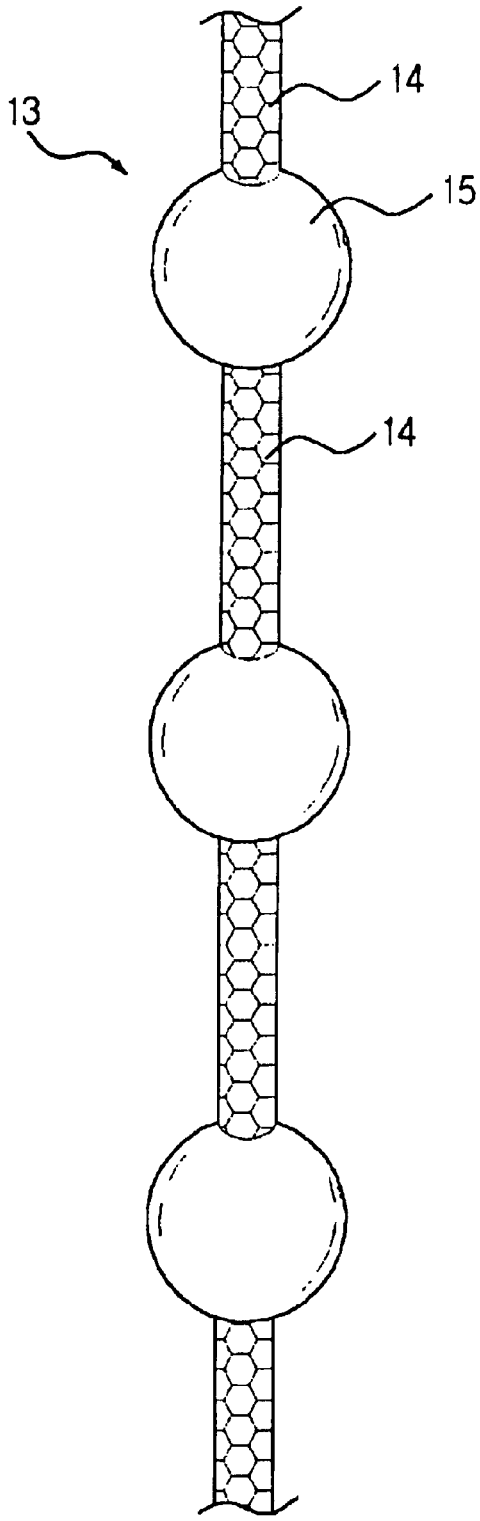
FIG. 7a (Prior Art)
FIG. 7*a* and FIG. 7*b* are schematic drawings of a conventional sunshade operating rope.
Figure 7B:
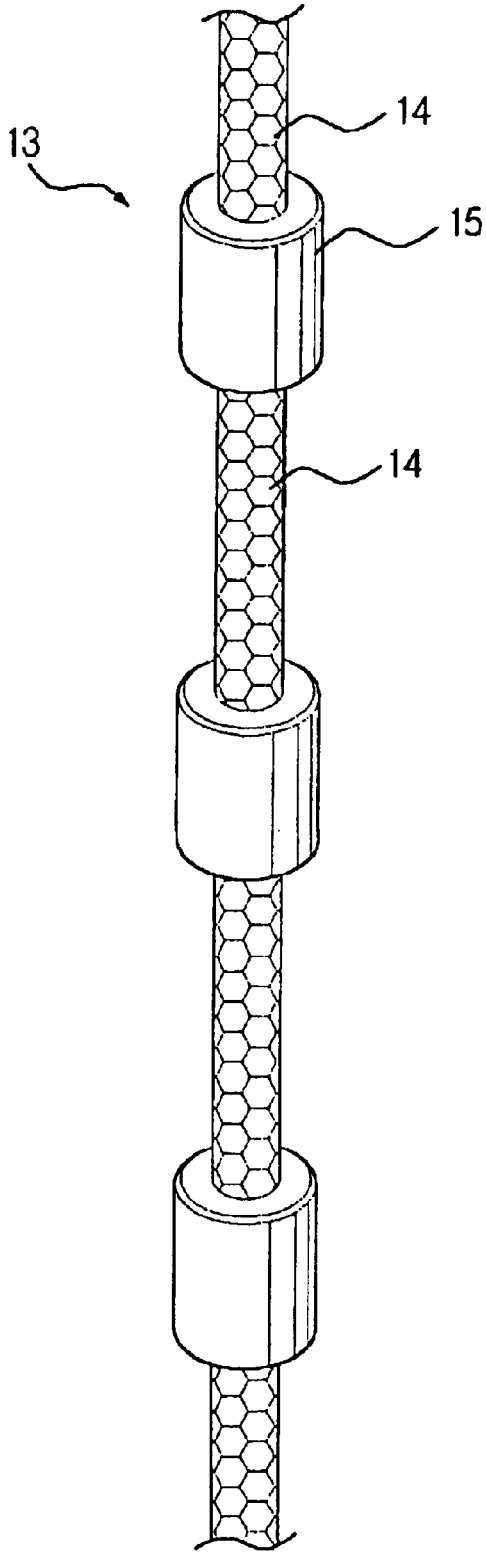
FIG. 7b (Prior Art)
Figure 8A:
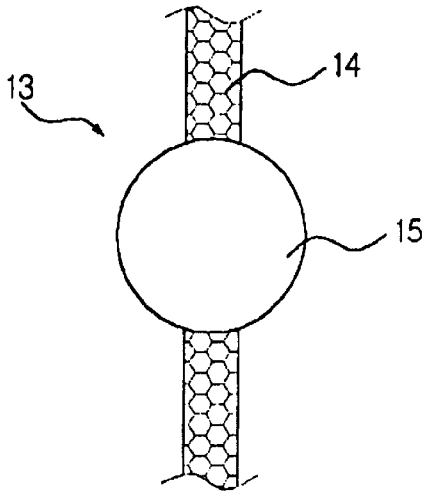
FIG. 8a (Prior Art)
FIG. 8*a* and FIG. 8*b* are front views of a conventional sunshade operating rope.
Figure 8B:
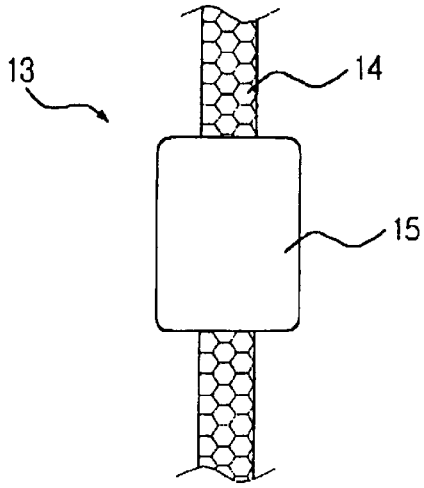
FIG. 8b (Prior Art)

FIGS. 5 and 6 illustrate a sunshade operating rope with a particular shape of directional indicator (5*a*) according to the third embodiment of the present invention. Contrast the first embodiment having a directional indicator (5*a*) integrally disposed either top or bottom of the bead (5) and second embodiment having a bead (5) and directional indicator (5*a*) separately disposed either top or bottom of the bead (5), the third embodiment is adopted a particular shape having a combined function of directional indicator (5*a*) and bead (5) as a solid piece. In the third embodiment, a top surface of the particular bead (5) could be an equilateral triangle. The lateral surface of the particular bead (5) could be an equilateral triangle or trapezoidal shape having relatively shorter width at the opposite side of the top surface. Then, the sunshade operating rope (3) passes through a center of the particular bead (5) for indicating a specific operating direction.

As shown in FIG. 5, the bead (5) has a regular tetrahedron with equilateral triangles. However, a conical shape is possibly used for a particular bead (5). Herein, a cross section of the particular bead (5) has either an equilateral triangle or trapezoidal shape. Therefore, it is possible to indicate a specific operational direction with the particular bead (5) as a solid piece.

Consequently, the present invention has an effect to easily distinguish the proper operating direction by glancing the pointing of directional indicators being attached on an operating rope. Therefore, when a user wants to operate the sunshade, the user is able to easily and correctly distinguish the proper side of the sunshade operating rope for pulling the desired direction due to the pointing of the directional indicator (5*a*).

While the present invention has been described in detail with its preferred embodiments, it will be understood that further modifications are possible. The present application is therefore intended to cover any variations, uses or adaptations of the invention following the general principles thereof, and includes such departures from the present disclosure as come within known or customary practice in the art to which this invention pertains within the limits of the appended claims.

What is claimed is:

1. An operating rope for operating a sunshade is comprised of:

a sprocket (2) of a clutch (1) for winding said operating rope, a shaft attached to said sprocket (2) of clutch (1) rotating to either open or close the sunshade, when a user pulls said operating rope to either opening or closing direction, said operating rope having a primary rope (4) and a plurality of beads (5) fixed on said primary rope (4) with equidistant intervals, said primary rope (4) passes through a center of beads (5) made of plastic material, and a plurality of directional indicators (5*a*) providing a function of directional indication with said beads (5) for pointing a proper operating direction, wherein said plurality of directional indicators (5*a*) is integrally formed with said beads (5) at either top end or bottom end of said beads (5) as a solid piece, size of directional indicators (5*a*) is relatively smaller than that of said beads (5) with respect to the cross sectional area.

2. An operating rope as claimed in claim 1, wherein said directional indicators (5*a*) disposed at either top end or bottom end of said beads (5) has either conical shape, spherical shape, cylindrical shape, semi-spherical shape, or oval shape.

3. An operating rope for operating a sunshade is comprised of:

a sprocket (2) of a clutch (1) for winding said operating rope, a shaft attached to said sprocket (2) of clutch (1) rotating to either open or close the sunshade, when a user pulls said operating rope to either opening or closing direction, said operating rope having a primary rope (4) and a plurality of beads (5) fixed on said primary rope (4) with equidistant intervals, said primary rope (4) passes through a center of beads (5) made of plastic material, and a plurality of directional indicators (5*a*) providing a function of directional indication with said beads (5) for pointing a proper operating direction, wherein said plurality of directional indicators (5*a*) is separately and closely disposed at either top side or bottom side of said beads (5) as two pieces, size of directional indicator (5*a*) is relatively smaller than that of said beads (5) with respect to the cross sectional area.

4. An operating rope as claimed in claim 3, wherein said directional indicators (5*a*) disposed at either top end or bottom end of said beads (5) has either conical shape, spherical shape, cylindrical shape, semi-spherical shape, or oval shape.

* * * * *